US007160022B2

(12) United States Patent
Krzywdziak et al.

(10) Patent No.: US 7,160,022 B2
(45) Date of Patent: Jan. 9, 2007

(54) PAINT STIRRING MACHINE AND METHOD FOR MOUNTING SAME

(75) Inventors: Alain Krzywdziak, Orleans (FR); Yannick Tanchoux, Darvoy (FR)

(73) Assignee: Fillon Technologies, Faverolies (FR)

( * ) Notice: Subject to any disclaimer, the term of this patent is extended or adjusted under 35 U.S.C. 154(b) by 191 days.

(21) Appl. No.: 10/497,051

(22) PCT Filed: Nov. 30, 2001

(86) PCT No.: PCT/FR01/03791

§ 371 (c)(1),
(2), (4) Date: Oct. 18, 2004

(87) PCT Pub. No.: WO03/045707

PCT Pub. Date: Jun. 5, 2003

(65) Prior Publication Data

US 2005/0041524 A1 Feb. 24, 2005

(51) Int. Cl.
*B01F 7/16* (2006.01)
*B44D 3/08* (2006.01)

(52) U.S. Cl. ..... 366/198; 366/605

(58) Field of Classification Search ..... 366/197–198, 366/242–251, 605
See application file for complete search history.

(56) References Cited

U.S. PATENT DOCUMENTS

| | | | | | |
|---|---|---|---|---|---|
| 1,842,938 | A | * | 1/1932 | Hancock | 366/251 |
| 2,428,492 | A | * | 10/1947 | Haller | 366/251 |
| 2,526,351 | A | * | 10/1950 | Grubelic | 366/198 |
| 2,603,461 | A | * | 7/1952 | Shwayder et al. | 366/251 |
| 2,757,910 | A | * | 8/1956 | O'Neill | 366/247 |
| 2,802,649 | A | * | 8/1957 | Stockton | 366/197 |
| 2,910,277 | A | * | 10/1959 | Brown | 366/197 |
| 2,965,363 | A | * | 12/1960 | Worden | 366/197 |
| 3,118,653 | A | * | 1/1964 | Dedoes | 366/200 |
| 4,225,248 | A | * | 9/1980 | Para | 366/251 |
| 4,299,500 | A | * | 11/1981 | Bassetti | 366/198 |
| 4,407,584 | A | * | 10/1983 | Boudin et al. | 366/279 |
| 5,017,017 | A | | 5/1991 | Godat et al. | |
| 5,096,071 | A | * | 3/1992 | Neri | 211/85.18 |
| 5,160,198 | A | | 11/1992 | Fillon | |
| 5,169,232 | A | * | 12/1992 | Fillon et al. | 366/249 |
| 5,310,258 | A | | 5/1994 | Godat et al. | |
| 5,496,109 | A | * | 3/1996 | Dedoes | 366/198 |
| 5,697,703 | A | * | 12/1997 | Lucchetti | 366/198 |
| 5,800,057 | A | * | 9/1998 | Lesimple | 366/198 |
| 5,904,420 | A | * | 5/1999 | Dedoes | 366/198 |

(Continued)

FOREIGN PATENT DOCUMENTS

EP 0065498 A2 * 11/1982

(Continued)

*Primary Examiner*—Charles E. Cooley
(74) *Attorney, Agent, or Firm*—Scully, Scott, Murphy & Presser, P.C.

(57) ABSTRACT

A paint stirring machine of the type driven by stirrer lids, on each of which is mounted a paint can, the stirrer lids being suspended by supports with lateral slide-rails on shelves (3) of the machine and individually driven by a front meshing pinion engaged on a rotating endless screw of the shelf, the machine including two vertical posts (1) supporting the shelves, one of the posts including, enclosed in a housing, the assembly of pulleys and belt driving the closed lids in a housing, the assembly of pulleys and belts driving the endless screws of the shelves. Furthermore, the endless screw bearings (19) and the assembly of pulleys and belts driving the endless screws are pre-assembled adjusted on the corresponding post (1).

14 Claims, 10 Drawing Sheets

U.S. PATENT DOCUMENTS

| | | | | |
|---|---|---|---|---|
| 5,947,598 | A * | 9/1999 | Dedoes | 366/198 |
| 6,033,106 | A * | 3/2000 | Lesimple et al. | 366/198 |
| 2005/0041524 | A1 * | 2/2005 | Krzywdziak et al. | 366/198 |
| 2005/0094487 | A1 * | 5/2005 | Mussatto | 366/198 |

FOREIGN PATENT DOCUMENTS

| | | | |
|---|---|---|---|
| EP | 0125213 | A2 * | 11/1984 |
| EP | 0127589 | A2 * | 12/1984 |
| EP | 0143145 | A2 * | 6/1985 |
| EP | 0143145 | B1 * | 9/1987 |
| EP | 0 298 806 | A | 1/1989 |
| EP | 0409715 | A1 * | 1/1991 |
| EP | 0630764 | A1 * | 12/1994 |
| EP | 0633055 | A1 * | 1/1995 |
| EP | 1488847 | A1 * | 12/2004 |
| FR | 2 102 417 | A | 4/1972 |
| FR | 2521493 | * | 8/1983 |
| FR | 2521493 | A1 * | 8/1983 |
| FR | 2562874 | A2 * | 10/1985 |
| FR | 2785953 | A1 * | 5/2000 |
| FR | 2874512 | A1 * | 3/2006 |
| GB | 2 203 059 | A | 10/1988 |
| IT | 01250630 | * | 4/1995 |
| WO | 03/045707 | A1 * | 6/2003 |

* cited by examiner

PAINT STIRRING MACHINE AND METHOD FOR MOUNTING SAME

BACKGROUND OF THE INVENTION

1. Field of the Invention

This invention relates to a paint stirring machine and the assembly method thereof.

It relates in particular to a machine with a drive for stirring lids, each of which bears a paint can, wherein the lids are suspended by means of lateral slide rails on shelves on the machine and individually driven by a front meshing pinion engaged on a worm gear rotating on the shelf.

2. Discussion of the Prior Art

A machine according to a close prior art has two vertical posts supporting the shelves, of which one bears the pulley and belt assembly enclosed in a housing to drive the shelf worm gears. However, each shelf has its own worm gear rotation axis which must be mounted on the corresponding post. Assembling the shelf bearing requires that the bearing be attached to the post, on one hand, and on the other hand, that the corresponding pulley and drive belt coupling be mounted into the post housing. In addition, mounting the gear motor drive at the base of the post requires specific tools and wrenches. This assembly work is relatively complex and time-consuming, and therefore requires qualified staff and a considerable work time.

SUMMARY OF THE INVENTION

This invention aims at correcting these disadvantages and proposes a paint stirring machine of the type with driven stirrer lids, on each of which is mounted a paint can, the stirrer lids being supported by means of lateral slide rails on shelves of the machine and individually driven by a front meshing pinion engaged on a rotating shelf worm gear, wherein the machine comprises two vertical posts, one of which bears the pulley and belt assembly driving the shelf worm gears enclosed in a housing, said machine being characterized in that the worm gear bearings and the pulley and belt assembly driving the worm gears are pre-mounted in an adjusted condition on the corresponding post.

Said worm gear bearings each include an axially tapped shaft accommodating a threaded rod of the worm gear coupling axis, so that the worm gear can be quickly assembled on the bearing with no other adjustment, by screwing the worm gear axially on its bearing.

The coupling between each worm gear and the corresponding post bearing can be implemented by means of a coupling joint, e.g. with a rubber pad engaged with two threaded end pieces, respectively in the tapped bearing shaft and the opposed end of the worm gear, wherein this joint functions as a gimbal joint compensating for the possible slight misalignments of the axis, dampens the drive jerks and ensures safety against an excessive drive force.

This invention also relates to the assembly method for this paint stirring machine.

The assembly method is characterized by the following steps:

- arranging the post bearing the pulley and drive belt assembly for the shelves on the gear motor so as to couple the drive belt of the pulley and drive belt assembly with the drive pulley of the gear motor,
- performing the final assembly of the gear motor on the post,

- connecting the two posts bearing the shelves in their vertical position by means of two rear bars hinged into a cross and attached to each of the posts at their ends,
- installing the shelves equipped with the worm gears conditioned to be held motionless on the posts,
- releasing the worm gears from their conditioning and screwing them for a locked attachment on the pre-mounted bearing axes, driving said bearings via the gear motor drive,
- connecting the shelves rigidly with a vertical middle bar that also rests on the floor to act as a middle support for the shelves, and
- attaching a head panel bearing information about the machine to the upper end of the posts.

In addition, it is advantageous to use a part called "comb" engaging the turns of the worm gear with its active toothed part and clamped with an arresting snap lock on the bearing profile or the shelf body to hold the worm gears conditioned and motionless, said comb part also allowing, when assembling the worm on its bearing, to shift it horizontally towards its bearing so as to ensure the screwed hold of its threaded axle rod into the corresponding bearing axle internal thread.

The result of this arrangement, as compared to the conventional machines quoted above, is that there is no need of a lengthy and difficult coupling work to drive each of the shelf worm gears on the corresponding drive post, by coupling and adjusting the pulley and drive belt thereof after assembling the axle bearing, wherein this coupling and assembly of the bearings is adjusted during manufacturing in the corresponding post according to the invention. This saves a considerable work time for specialist staff.

BRIEF DESCRIPTION OF THE DRAWINGS

Other advantageous assembly and mounting features of the paint stirring machine according to this invention arc described below in relation with the appended drawings, wherein.

DETAILED DESCRIPTION OF THE DRAWINGS

Figure 1:
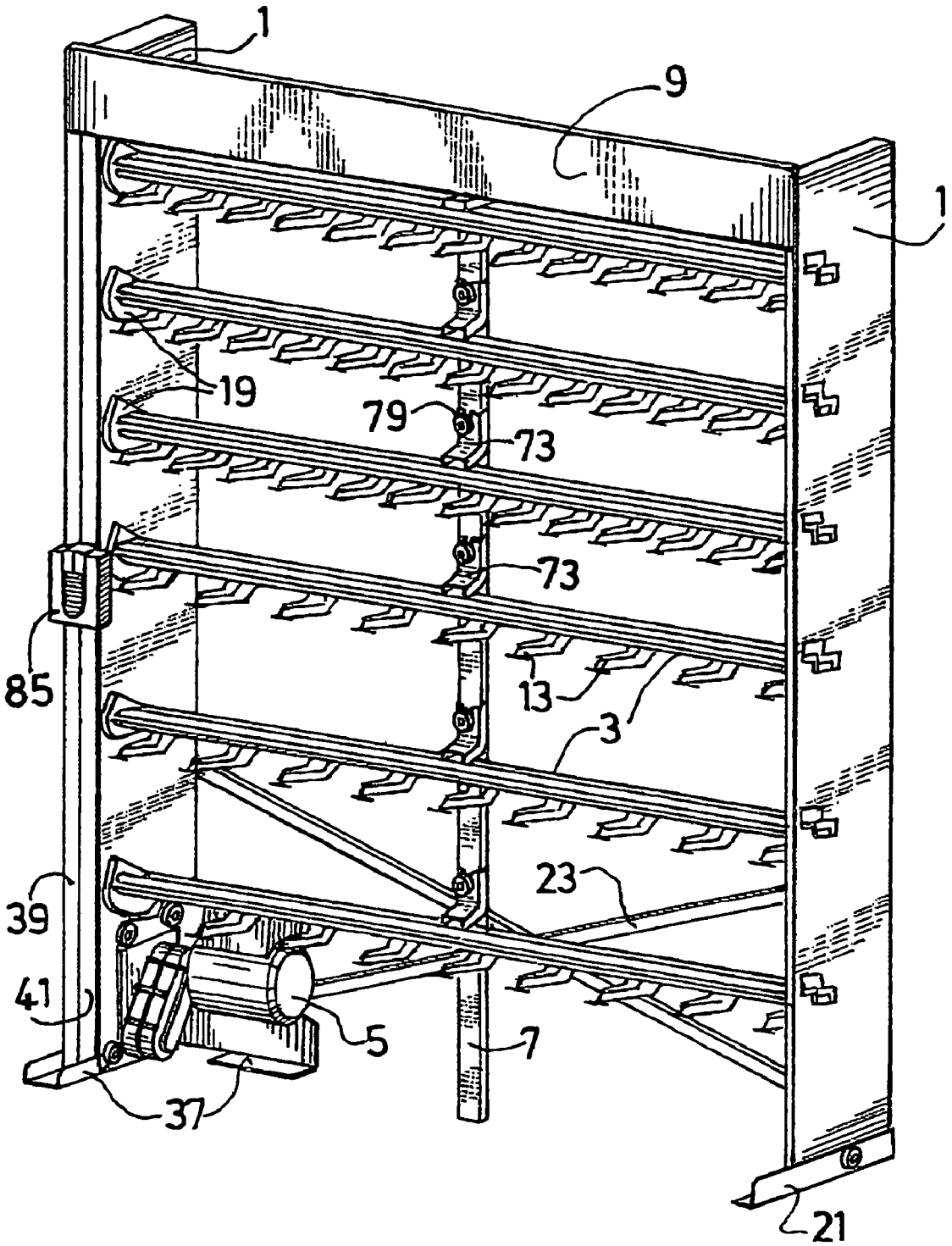
FIG. 1 is a perspective view of the stirring machine according to the invention as mounted.
Figure 2:
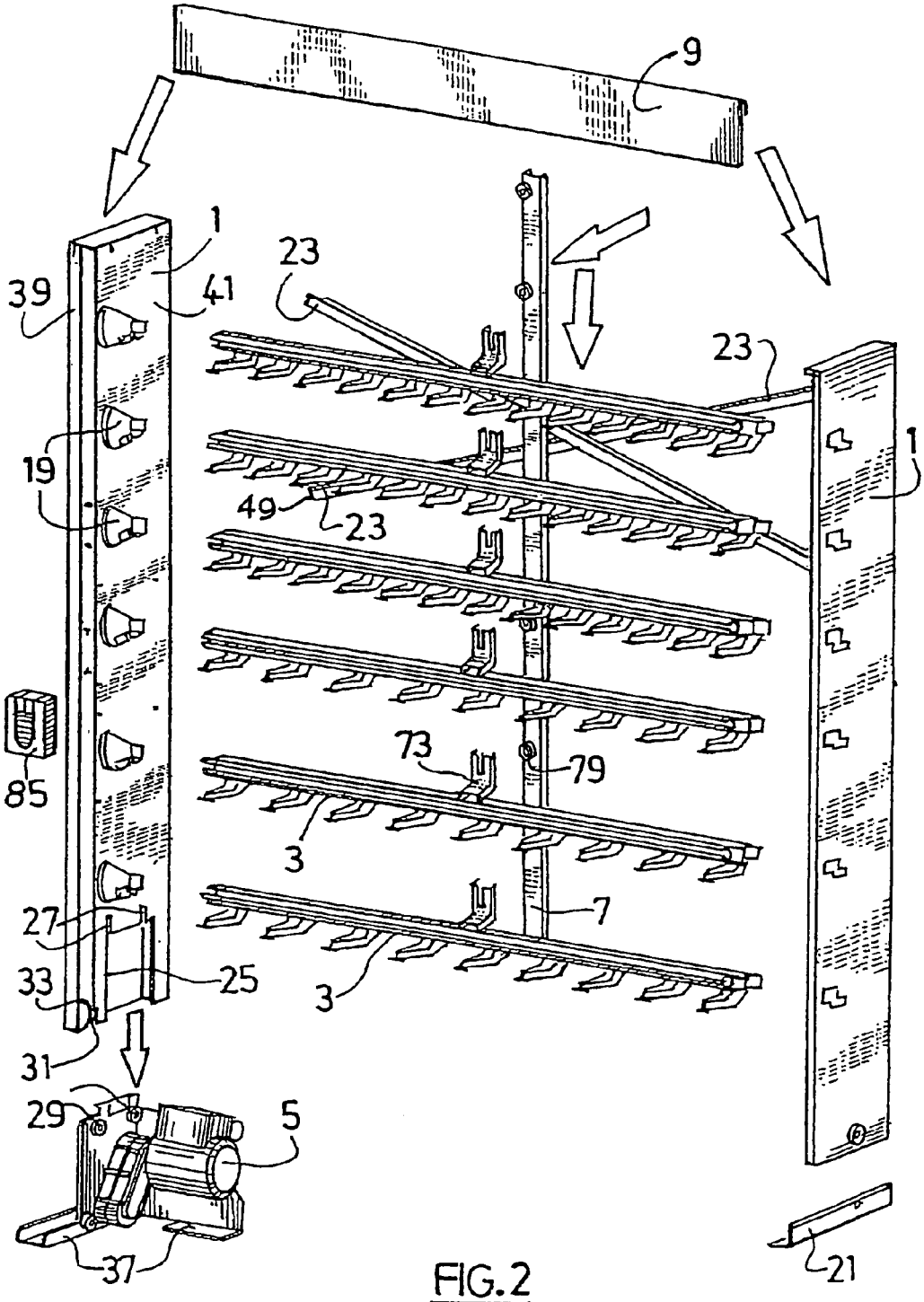
FIG. 2 is a cut-away view of the machine showing its individual components.

As represented in FIGS. 1 and 2, the paint stirring machine according to the invention mainly comprises two vertical posts 1 on which are installed shelves 3 to drive the stirring lids (not represented), a lower gear motor 5, a vertical middle bar 7 connected to the shelves 3 and an upper vertical head panel 9 assembled to the two vertical posts 1 of the machine.

The stirring machine belongs to the type with a worm gear 11 driving the stirring lids, which are slidably engaged on slide rails 13 of the shelf and engaged to be driven on the worm gear 11 by a front rack in contact with the worm turn.

The posts 1 carry the shelves 3 in a substantially horizontal arrangement and at a varying height from each other, according to the size of the suspended paint cans, with the lower shelves generally bearing the largest cans.

The post 1 located on the left of the drawing encloses the pulley and drive belt assembly 15 for each of the shelf worm gears, which assembly is coupled by a belt 17 to the output pulley of the gear motor attached to the base of the post.

The pulley and belt assembly 15 in the post and the opposed shelf coupling bearings 19 are attached and adjusted during manufacturing on the inner side of the post. The post is delivered fully equipped. The other post on the right is only used to support the shelves opposite the left post, using a lower foot 21.

The middle bar 7 is rigidly connected to the shelves 3 and, since it stands on the floor, also ensures a supporting function for the middle part of the shelves against the weight of the supported cans.

The upper head panel 9 connects the posts in their upper part, as do the lower parts of two bars 23 hinged into a cross.

The assembly of the machine shall now be described. It can be effected quickly, in less than 15 minutes per machine, without tools and thus manually, and by one person.

Figure 3:
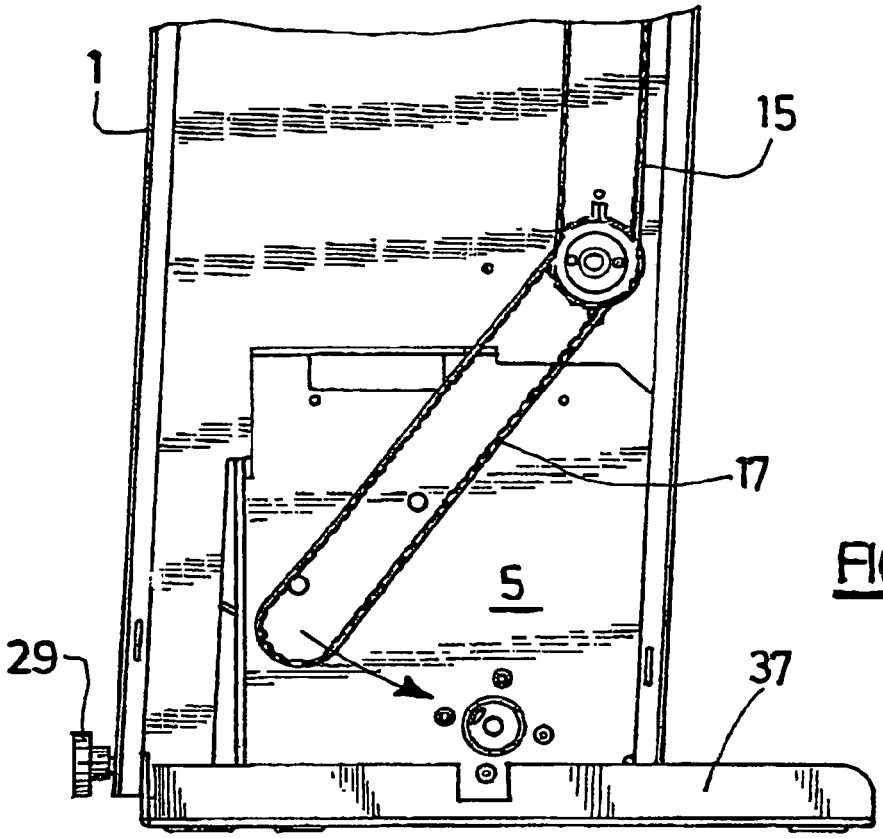
FIGS. 3 and 3*a* are rear views showing the assembly of the gear motor on the shelf drive post of the machine.
Figure 3A:
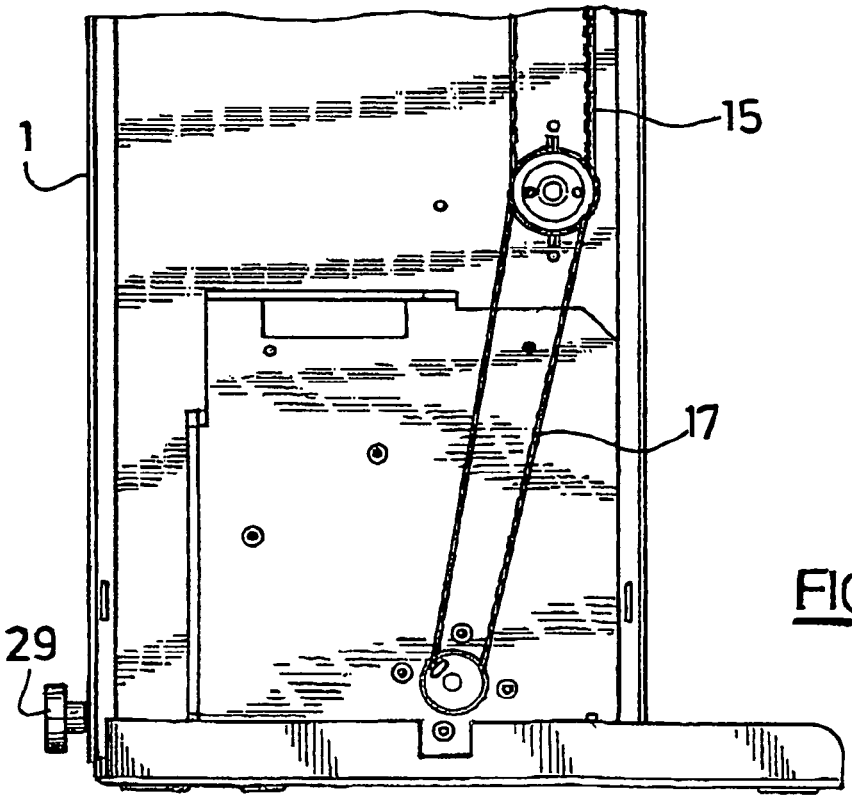

The driving post 1 fully equipped with its internal pulley and drive belt assembly 15 and the shelf drive bearings 19 is first arranged on the gear motor support 5. The gear motor is accommodated in the lower inside cavity 25 of the post. This substantially rectangular cavity 25 has two distant upper vertical lumens 27 that allow attachment by tightening a corresponding hand knob screw 29 each screwed integrally with the gear motor support. A vertical lumen 31, of which the inner end part 33 is tilted forwards, is also formed on the inner front edge of the post. The back heel of the post has another vertical lumen for engagement with a corresponding tightening knob screw 29 integral with the gear motor. The post is positioned by inserting its front lower lumen 31 onto the corresponding knob screw 29 of the motor gear support in a position that is naturally tilted forwards. This position (FIG. 3) makes it easier to mount the coupling belt 17 of the gear motor output pulley opposite the drive assembly 15 of the post. When the belt is mounted, the post is noticeably straightened up into a vertical position (FIG. 3*a*), which position can be arrested by tightening the back heel knob. The belt is adjusted taut then locked in position by the back upper knob. The front upper and lower knobs are then tightened to lock the assembly between the post and the gear motor. The assembly rests vertically on the floor in a stable position and is held by its front and transverse lower feet 37 integral with the gear motor support.

Figure 10:
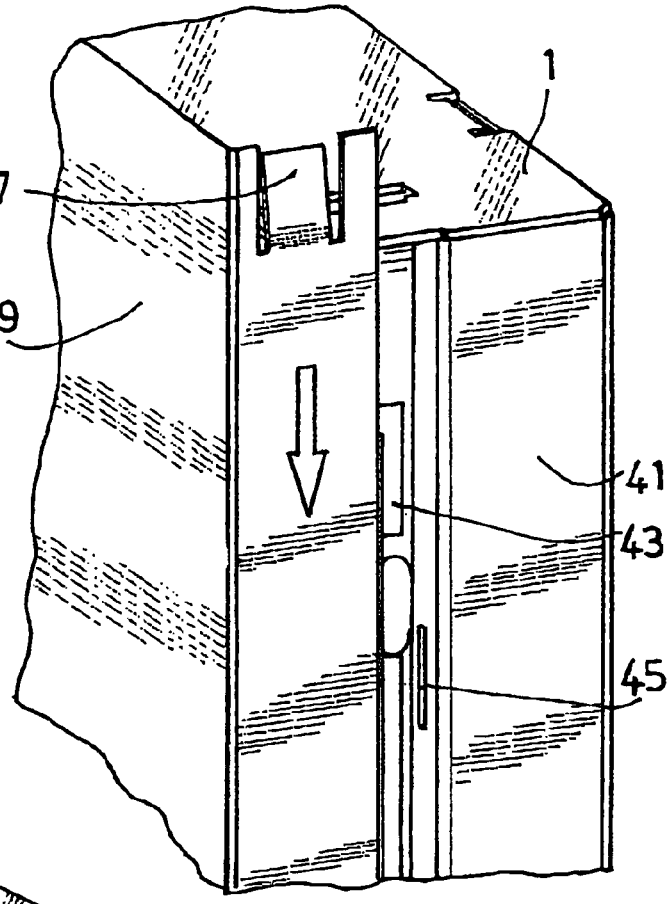
FIGS. 10 and 11 show the closure of the drive post housing.
Figure 11:
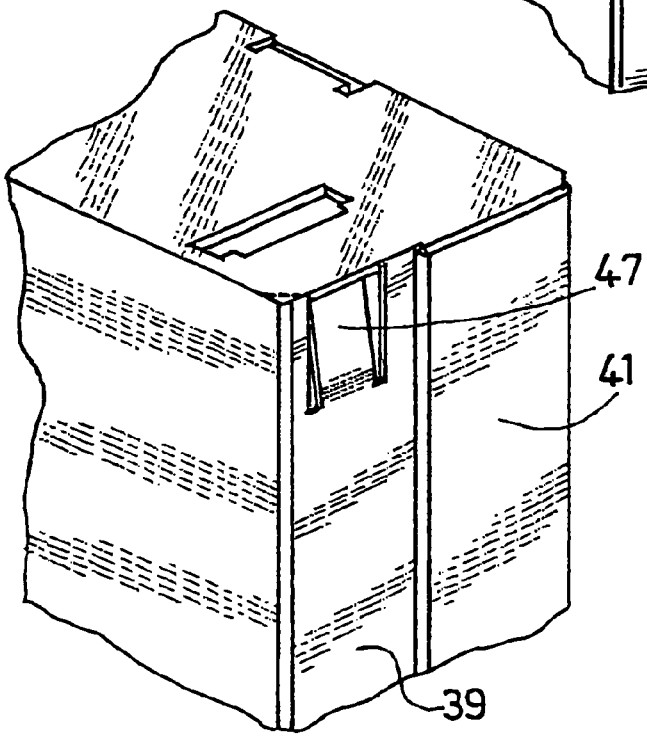

The external housing of this post must then be formed, although this enclosure can be provided at a later stage. For safety and to isolate the pulleys and belts of the driving assembly, this enclosure can be performed at that stage. It is illustrated by FIGS. 10 and 11.

The external housing metal panel 39 of the post, complementary with the internal metal panel 41, both forming a rectangular housing when assembled, has four lateral legs 43, one at the bottom and one at the top of each front and back side, engaged to slide vertically downwards as shown by the arrow into complementary lumens 45 of the internal housing plate. The external housing metal panel 39 also as an upper tongue 47 on each of its opposite front and back sides, which is cut out of the upper side part of the panel. This tongue 47 can be turned inwards with a strong return force so that when the external housing metal panel 39 is engaged downwards on the internal housing panel 41 with an adjustment in edge height at the upper level, this tongue stands out of the upper edge of the internal housing, returns inwards and below it and thus prevents the internal housing to rise relative to the external housing, unless this tongue is pulled outwards at the risk of deforming it, e.g., with a blade tool.

Now the two shelf support posts 1 must be connected. This is achieved by means of two cross-bars 23 hinged in their middle so that their ends form a rectangle; said ends have lower indentations 49 arranged symmetrically relative to the hinge, which engage with rear hook parts (not represented) standing out from each of the shelf support posts by pairs at the bottom of each of the posts.

As soon as they are mounted on the posts, these cross-bars connect them vertically and thus form a mounting template for the shelves supporting the stirring lids, as described below.

Figure 6:
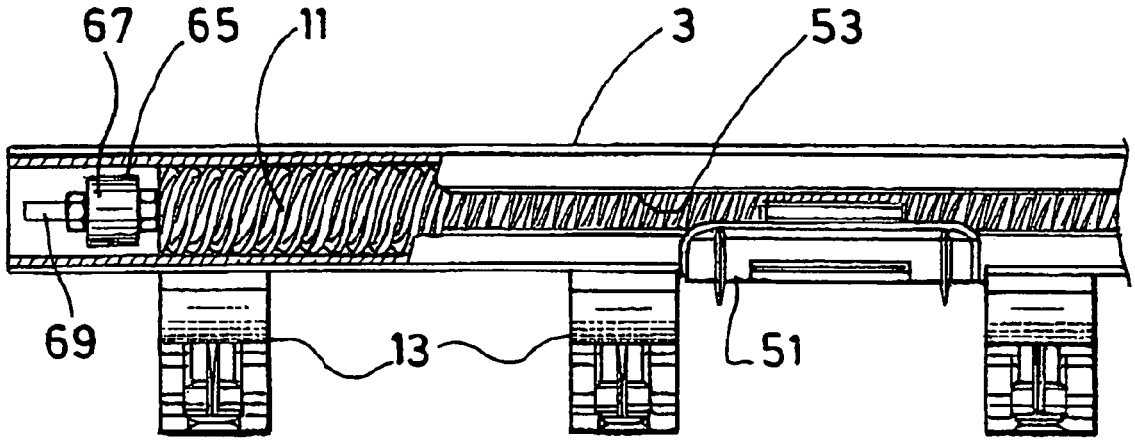
FIG. 6 shows the shelf coupling end.

The shelves 3 are delivered with their worm gear 11 (FIG. 6) held conditioned and motionless by means of a part called comb 51 engaging the worm turns with its active comb part in their front slit 53 and snap-locked onto the body of the shelf.

Figure 4:
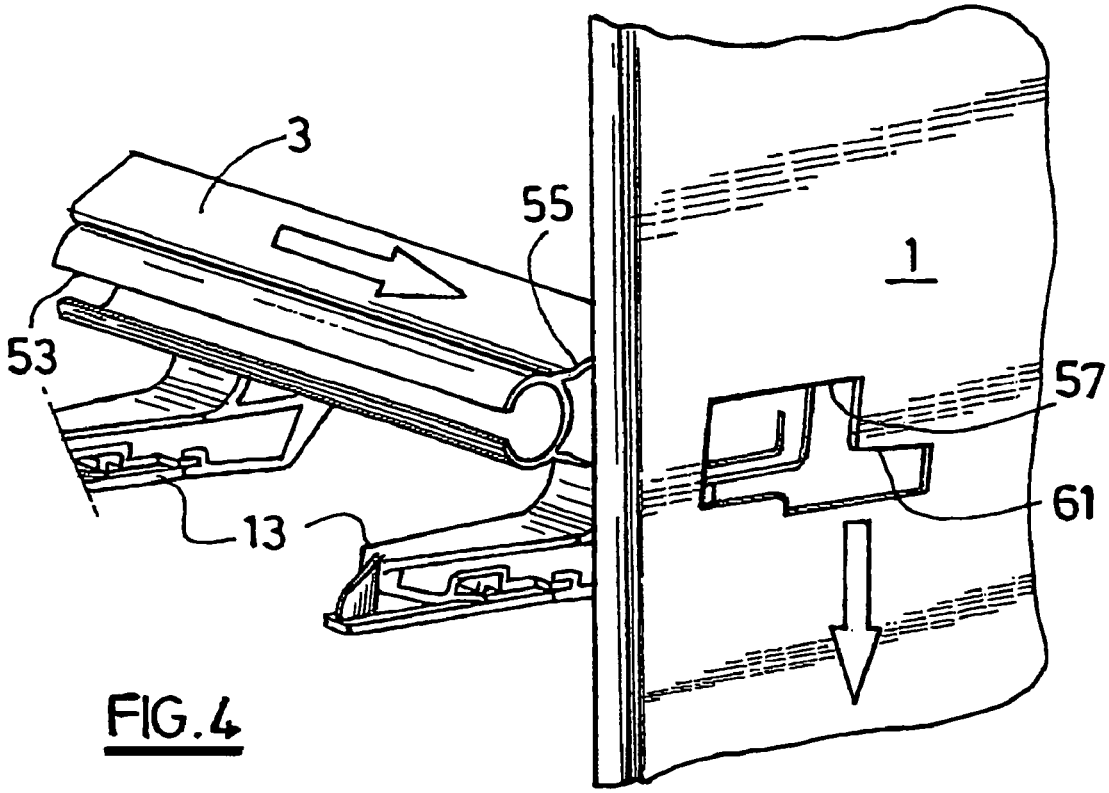
FIGS. 4 and 5 are views showing the assembly of the uncoupled shelf end on the corresponding support post of the machine.

Each shelf is successively inserted at its free end 55 (FIG. 4) into a complementary recess 57 of the right post formed at an adequate height on the post for each shelf to be supported.

Figure 5:
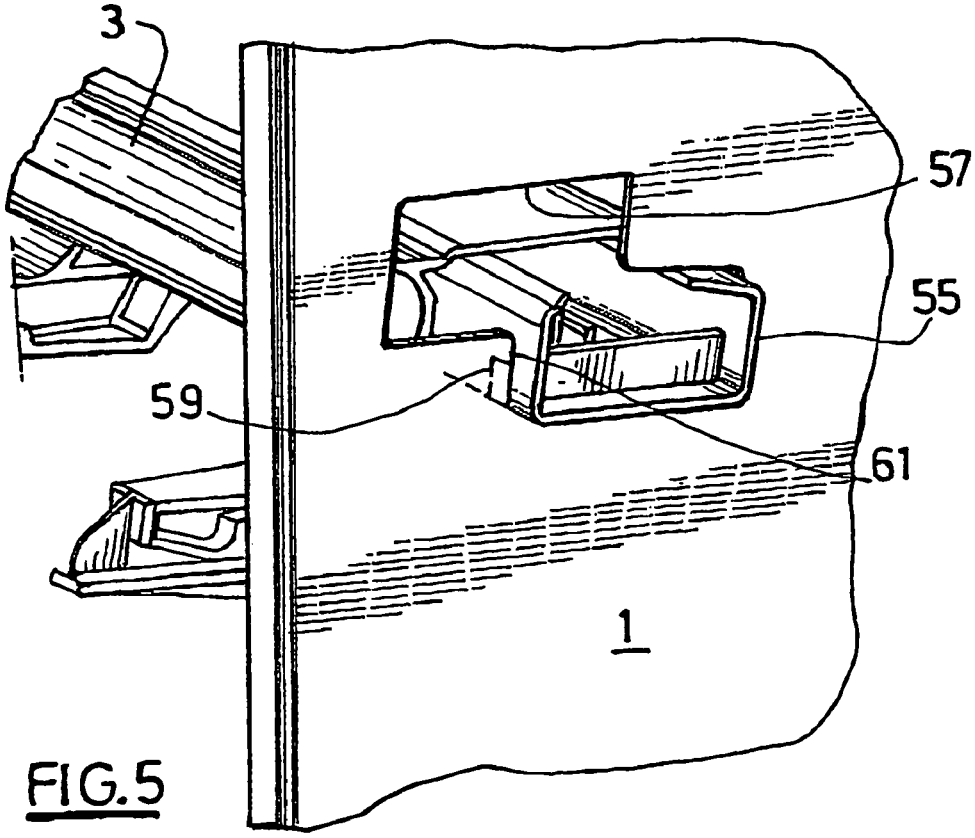

The end of the shelf has two vertical lower lateral indentations 59 wherewith it can be engaged down to be snap-locked transversally into said recess 57 then shifted backwards (FIG. 5) into a narrow lower setback 61 preventing the shelf end to rise and shift to the front.

The shelf positioned so as to slide freely in the post recess 57 is brought towards the corresponding worm gear bearing 19, which is first attached at an adequate height on the drive post as explained above. The shelf is then snap-locked at its end opening 63 (FIG. 7*a*) on the complementary body of the bearing 19. At the end of the engagement (FIG. 7*b*), the shelf is automatically locked in position by the parts engaging snap locked into place.

Figure 7:
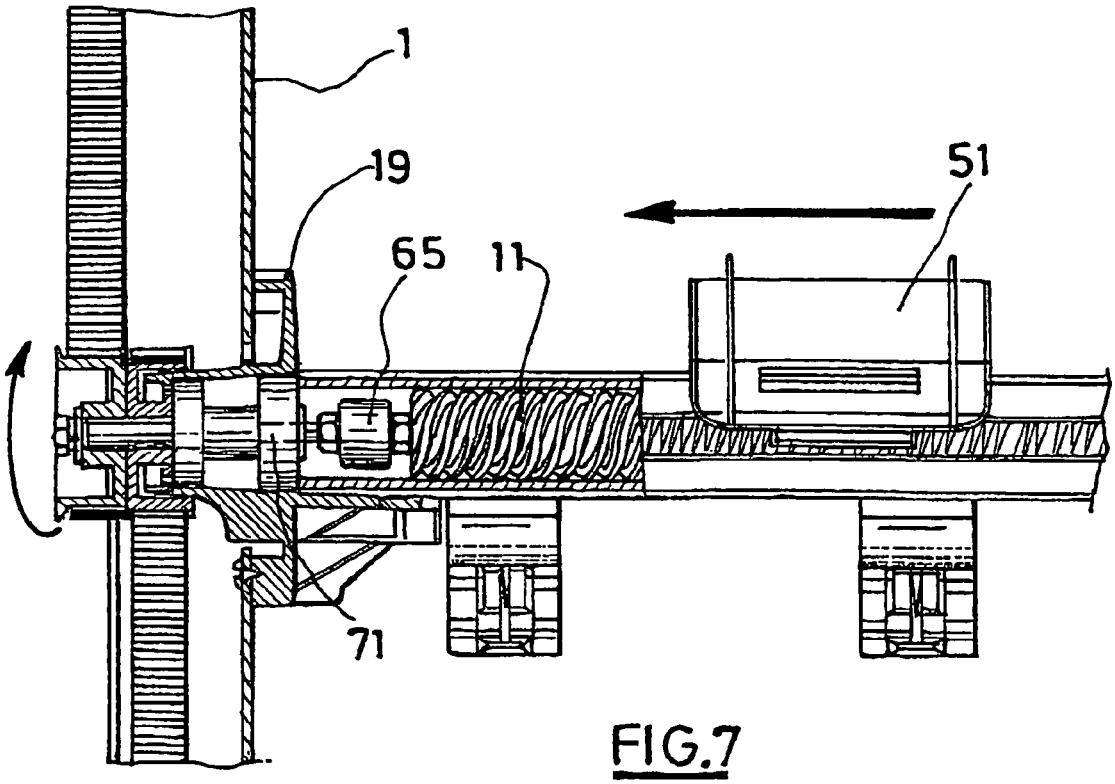
FIGS. 7, 7*a* and 7*b* show the coupling of the shelf on the corresponding shelf drive post.
Figure 7A:
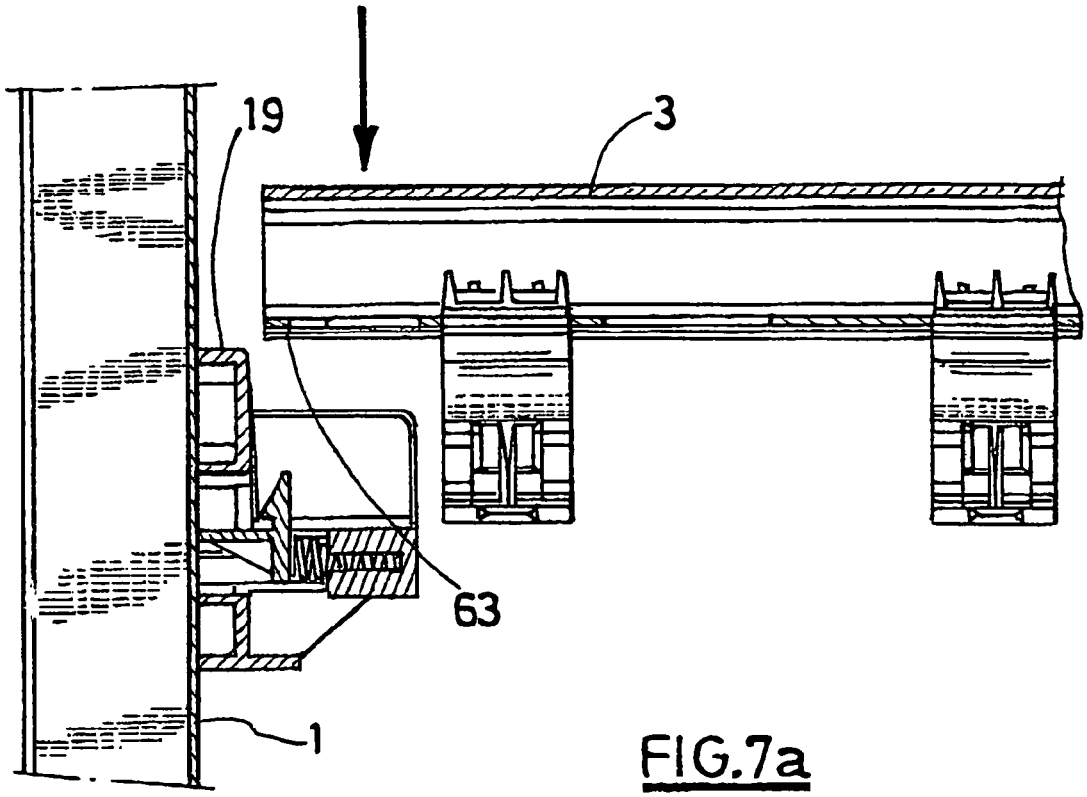
Figure 7B:
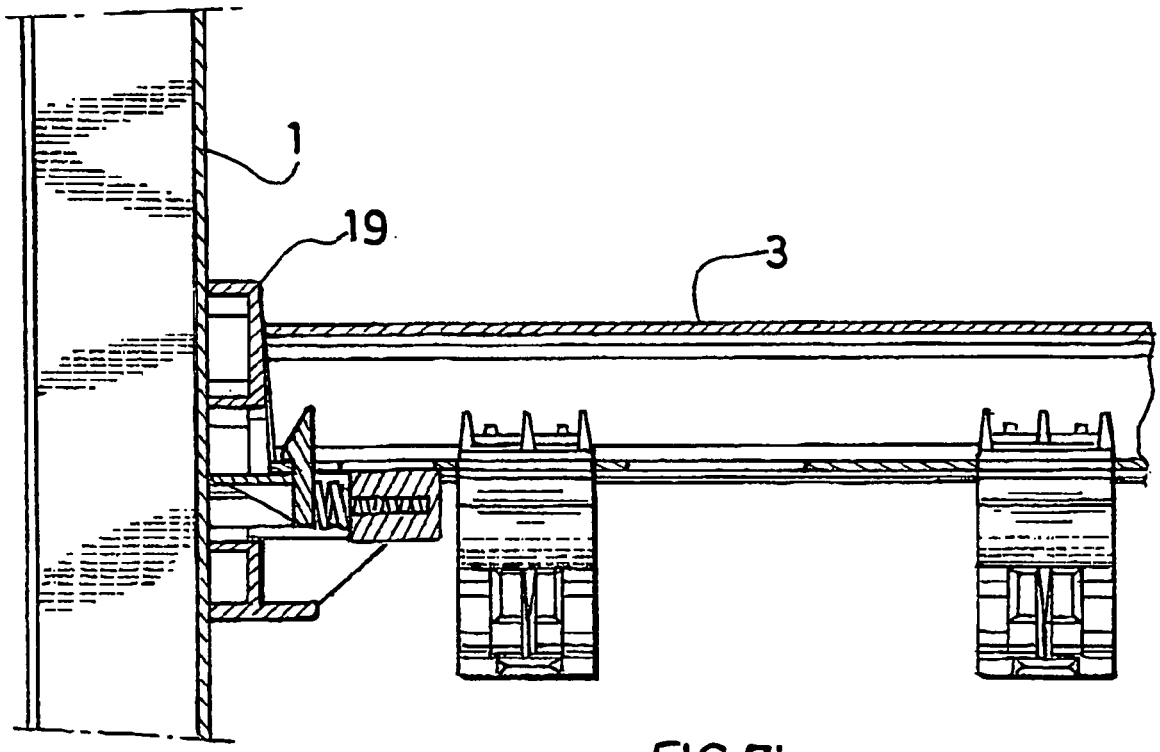

The worm gear 11 is coupled to its bearing 19 in a simple and quick way, as explained below with reference to FIG. 7.

Each worm 11 has at its end on the bearing side a coupling joint 65 with a rubber pad or head 67, with two opposed threaded plugs of which one is threaded into the screw end by a complementary internal thread and the other 69 is designed to be screwed to the bearing. This coupling joint allowing a resilient axial connection between the worm and its bearing (functioning as a gimbal joint, a damper and a drive security) is designed to be screwed at its end plug 69 into a complementary axial internal thread 71 of the internal bearing shaft.

To achieve this, the comb part 51 is removed from its conditioning snap lock and left engaged with the worm turn, and the worm 11 is shifted towards the bearing 19 and into contact between the threaded joint plug 69 and the corresponding internal thread 71 in the bearing shaft. The bearing shaft is rotated by the motor to screw the bearing shaft onto the corresponding coupling joint plug of the rotating worm. At the end of the screwing process, the assembly abuts and drives the worm. Once the worm gear has been coupled with the post bearing, the bearing shaft drive helps perfecting the screwed assembly between the worm and its bearing by always driving it in the same direction.

The other shelves are assembled in the same way.

Figure 8:
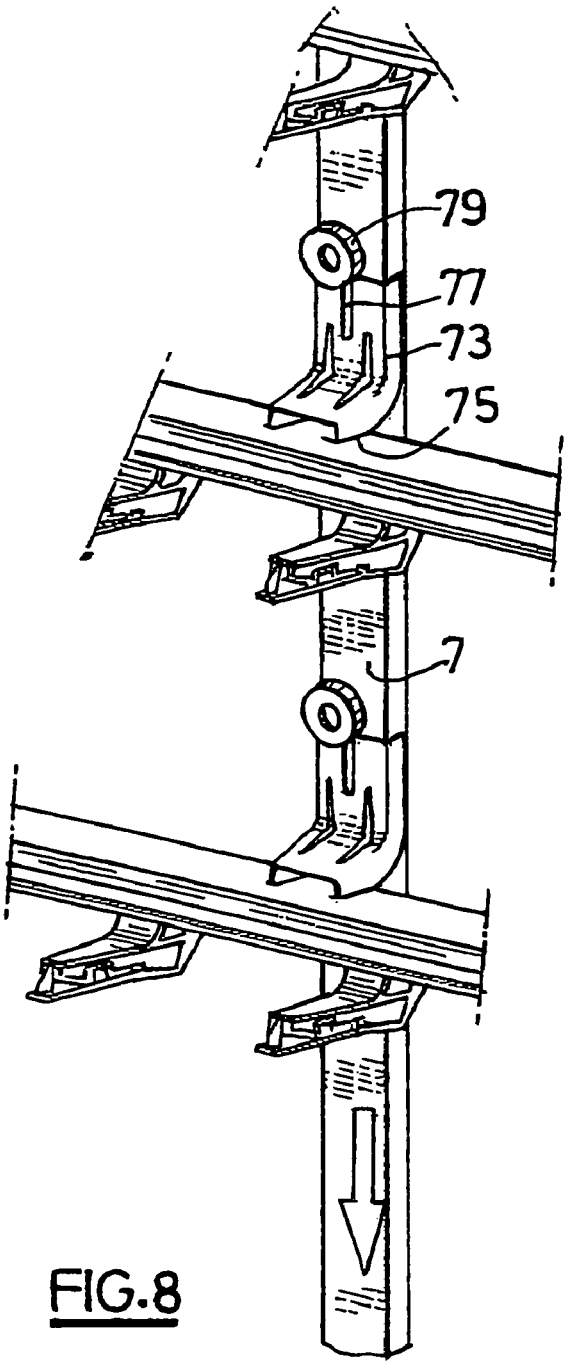
FIGS. 8 and 9 show the assembly of the middle shelf connecting bar.
Figure 9:
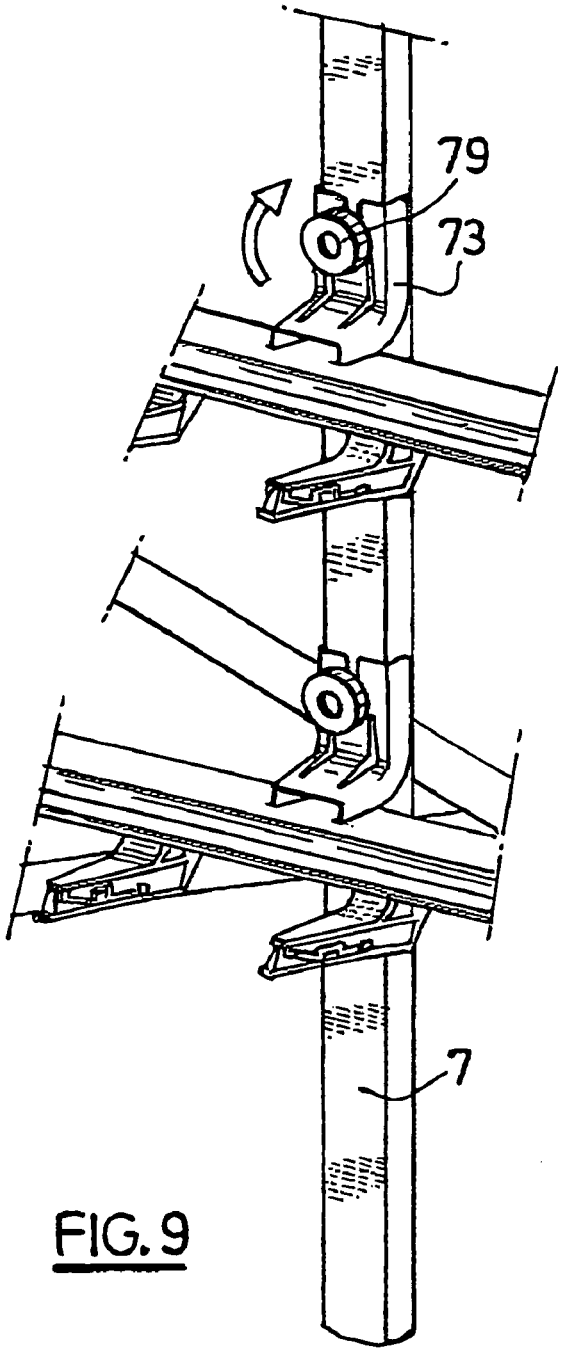

When all shelves are mounted, the middle bar 7 connecting the shelves can be mounted (FIGS. 8 and 9). This bar has locking parts 73 snap-locked with the shelves and engaged into appropriate upper lumens 75 in the shelves and adequately attached each at a given height on the bar according to the position of the shelves in height. These parts have an upper vertical lumen 77 that accommodates the knobbed head of a quick hand screw 79 screwed into the bar body, so that its height can be adjusted along their height. The bar 7 is thus pushed downwards as indicated by the arrow to enable the snap-locked engagement of the engaging parts 73 on the shelves, then the knobbed hand screws 79 are tightened to adjust to each shelf, with the end of the bar resting on the floor.

Figure 12:
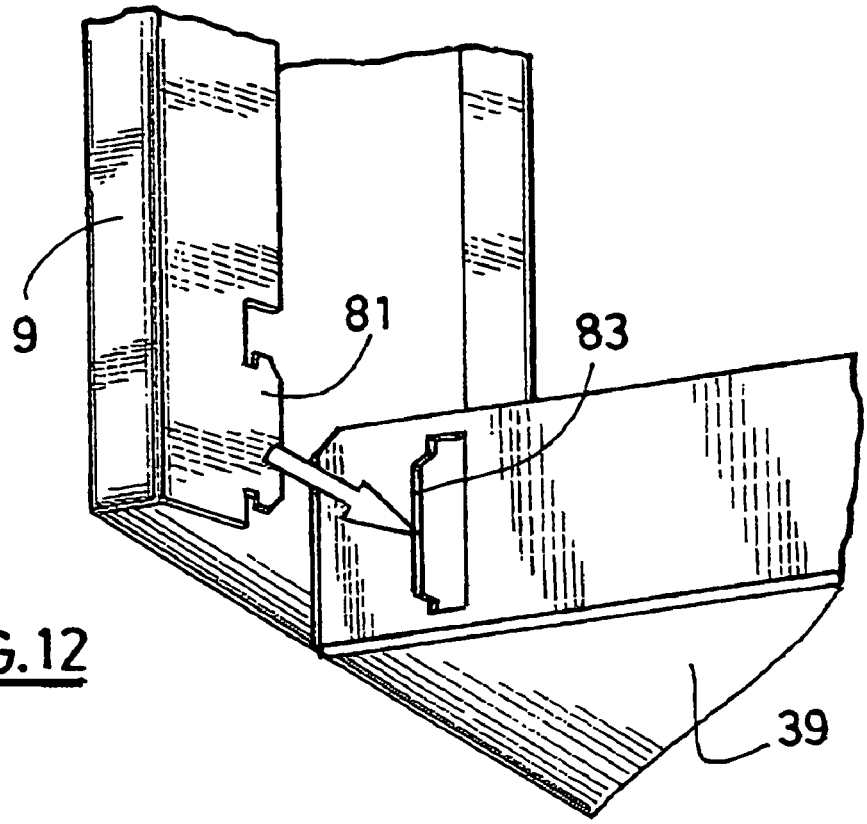
FIGS. 12 and 13 show the assembly of the upper panel on the machine posts.
Figure 13:
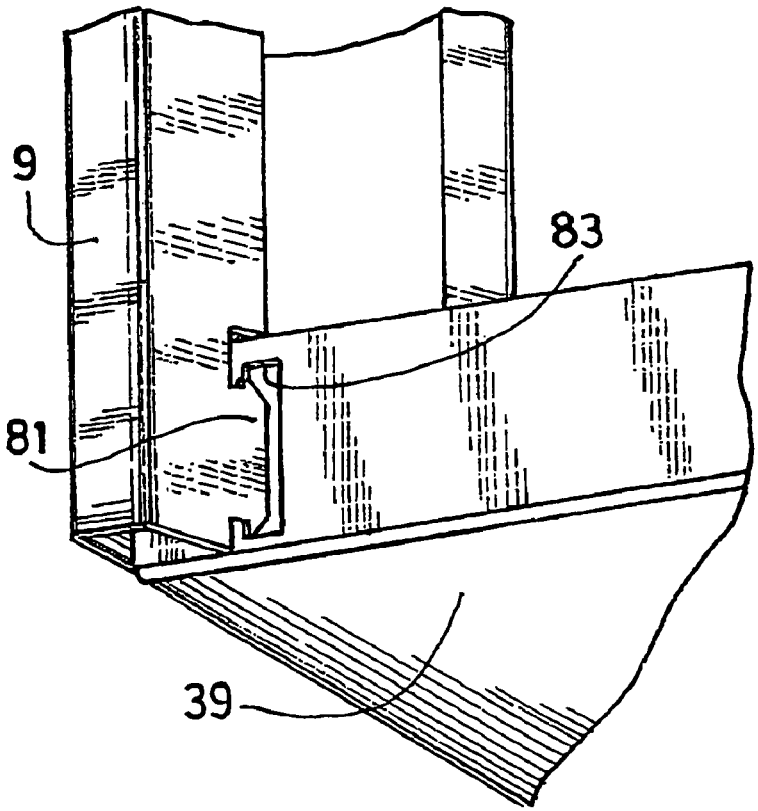

The upper head panel 9 then remains to be mounted at the end of the posts (FIGS. 12, 13).

The head panel 9 has two opposing lateral hooking fingers 81 snap-locking into complementary indentations 83 provided at the front upper end of the posts. The head panel 9 is laid vertically on the front upper part of the posts, as indicated by the arrow, so that the head panel fingers come into the respective indentations of the post and are hooked and locked therein by engaging the hooks to the front while the head panel is pressed against the posts.

Other accessories can also be mounted, such as the control switch 85 for machine operation, which is also snap-locked on the drive post 1 with an automatic contact connection to the electrical power supply system of the machine.

The above shows that the paint stirring machine according to the invention can be assembled with extreme ease, with no special tools and with a self-engagement of the components in the specified order, by one person and within less than 15 minutes, without having to adjust any drive coupling.

Figure 14:
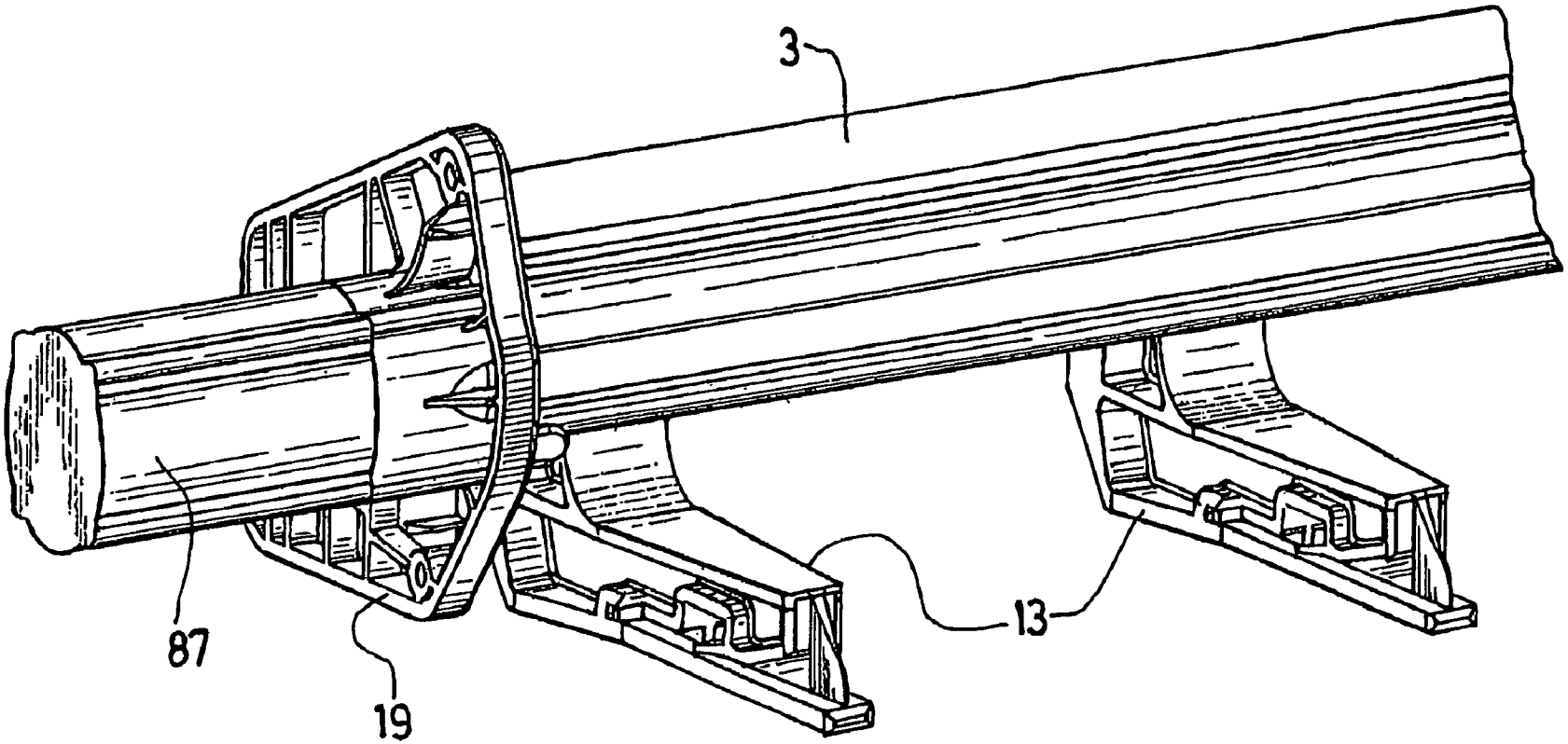
FIG. 14 shows a machine shelf according to a variant.

As a variant of the machine (FIG. 14), it should be noted that the gear motor set 5 can be replaced by a number of small electric motors 87 arranged into the post to replace the shelf bearing pulleys and driving the worm gears of the shelves directly via external bearings 19 identical to those described above, wherein the motors can also turn at varying speeds and at a different speed from each other. This arrangement also provides more freedom to position the shelves without any constraints from the pulley and belt assembly on the post.

The invention claimed is:

1. Paint stirring machine with a drive for stirring lids, each of which bears a paint can, wherein the stirring lids are suspended by means of lateral slide rails on shelves (3) on the machine and individually driven by a front meshing pinion engaged on a worm gear (11) rotating on the shelf, which machine comprises two vertical posts (1) supporting the shelves, of which one bears the pulley and belt assembly (15) enclosed in a housing to drive the shelf worn gears (11), characterized in that the worm gear bearings (19) and the pulley and belt assembly (15) driving the worm gears are pre-mounted in an adjusted condition on the corresponding post (1) and said worm gear bearings (19) each include an axially tapped shaft accommodating the threaded rod of the worm gear (11) axis, so that the worm gear (11) can be quickly assembled on the bearing (19) with no other adjustment, by screwing the worm gear axially on its bearing.

2. Stirring machine as per claim 1, characterized in that the coupling between each worm gear (11) and the corresponding post bearing (19) can be implemented by means of a coupling joint (65).

3. Stirring machine as per claim 2, characterized in that said coupling joint (65) is of the type with a rubber pad or head (67) engaged with two threaded end pieces (69), respectively in the tapped bearing (19) shaft and the opposed end of the worm gear (11), wherein this joint functions as a gimbal joint compensating for the possible slight misalignments of the axis, dampens the drive jerks and ensures safety against an excessive drive force.

4. Assembly method for a paint stirring machine as defined in any one of the preceding claims, characterized in that it includes the following steps:

arranging the post (1) bearing the pulley and drive belt assembly (15) for the shelves on the gear motor (5) or its support so as to couple the drive belt (17) of the pulley and drive belt assembly (15) with the drive pulley of the gear motor (5), performing the final assembly of the gear motor on the post (1), connecting the two posts (1) bearing the shelves in their vertical position by means of two rear bars hinged into a cross (23) and attached to each of the posts (1) at their ends, installing the shelves (3) equipped with the worm gears (11) conditioned to be held motionless on the posts (1), releasing the worm gears (11) from their conditioning and screwing them for a locked attachment on the pre-mounted bearing (19) axes, driving said bearings via the gear motor drive (5), connecting the shelves (3) rigidly with a vertical middle bar (7) that also rests on the floor to act as a middle support for the shelves, and attaching a head panel (9) bearing information about the machine to the upper end of the posts (1).

5. Assembly method for a paint stirring machine as per claim 4, characterized in that said gear motor (5) or its support is accommodated in the lower inside cavity (25) of the corresponding post and attached thereto by means of hand knob screw (29) screwed integrally with the gear motor (5) and tightened into appropriate lumens of the post housing, wherein the lumens allow adjusting the tension of the coupling belt (17) from the post drive assembly to the gear motor and arresting the position of the assembly thus obtained.

6. Assembly method for a paint stirring machine as claimed in claim 4, characterized in that a vertical lumen, of which the inner end part (33) is tilted forwards, is formed on the inner front edge of the post (1), that the back heel of the post has another vertical lumen for engagement with a corresponding tightening hand knob screw integral with the gear motor, and that the post (1) is positioned by inserting its front lower lumen onto the corresponding knob screw of the motor gear in a position that is naturally tilted forwards, which position makes it easier to mount the coupling belt (17) of the gear motor output pulley opposite the drive assembly of the post, and when the belt (17) is mounted, the post (1) is noticeably straightened up into a substantially vertical position and arrested by tightening the back heel knob screw, after which the belt (17) is adjusted taut then locked in position by the back upper knob screw, the front upper and lower knob screw then being tightened to lock the assembly between the post and the gear motor and the resulting assembly resting vertically on the floor in a stable position and being held by its front and transverse lower feet (37) integral with the gear motor support.

7. Assembly method for a paint stirring machine as claimed in claim 4, characterized in that the drive post (1) comprises an external housing metal panel (39) and an internal metal panel (41) accommodating the shelf drive and bearing (19) assembly (15), in that the external housing metal panel is closed integral with the internal housing metal panel by engagement of interlocking legs (43) engaged to slide vertically downwards into complementary lumens (45) of the internal housing plate, wherein the external housing metal panel also has an upper tongue (47) on each of its opposite front and back sides, which is cut out on the upper side part of the panel, said tongue (47) being turned inwards with a strong return force so that when the external housing metal panel is engaged downwards on the internal housing panel, this tongue (47) stands out of the upper edge of the internal housing (41), returns inwards and below it and thus prevents the internal housing (41) to rise relative to the external housing (39).

8. Assembly method for a paint stirring machine as claimed in claim 4, characterized in that there is provided in addition a so-called comb part (51) engaging the turns of the worm gear (11) with its active toothed part and clamped with an arresting snap lock on the shelf body to hold the worm gear (11) conditioned and. motionless, said comb part (51) also allowing, when assembling the worm (11) on its bearing (19), to shift it horizontally towards its bearing so as to ensure the screwed hold of its threaded axle rod into the corresponding bearing (19) axle internal thread.

9. Assembly method for a paint stirring machine as claimed in claim 4, characterized in that each shelf (3) is successively inserted at its free end (55) into a complementary recess (57) in a post, wherein the end of the shelf has two vertical lower lateral indentations (59) wherewith it can be engaged down to be snap-locked transversally into said recess (57) then shifted backwards into a narrow lower setback (61) of the recess preventing the shelf end to rise and shift to the front, wherein the shelf positioned so as to slide freely in the post recess (57) is brought towards the corresponding worm gear bearing (19) and engaged to be arrested at its end opening (63) on the complementary body of the bearing (19) then automatically locked in position by the parts engaging snap locked to place.

10. Assembly method for a paint stirring machine as claimed in claim 4, characterized in that in order to couple the worm gear (11) with its bearing (19), the comb part (51) is removed from its conditioning snap lock and left engaged with the worm turn, and the worm (11) is shifted towards the bearing (19) and into contact between the threaded shaft or coupling joint plug (69) and the corresponding internal thread (71) in the bearing shaft, and the bearing shaft is then rotated by the motor to screw the bearing shaft onto the corresponding coupling joint plug of the rotating screw, and at the end of the screwing process, the assembly abuts and drives the screw.

11. Assembly method for a paint stirring machine as claimed in claim 4, characterized in that said middle bar (7) comprises locking parts (73) snap-locked with the shelves (3), which parts have an upper vertical lumen (77) that accommodates the knobbed head of a quick hand screw (79) screwed into the bar body, so that its height can be adjusted along their height, and the bar (7) is pushed downwards to enable the snap-locked engagement of the engaging parts on the shelves, then the knobbed set screws (79) are tightened to adjust to each shelf, with the end of the bar resting on the floor.

12. Assembly method for a paint stirring machine as claimed in claim 4, characterized in that said head panel (9) has two opposing lateral hooking fingers (81) snap-locking into complementary indentations (83) provided at the front upper end of the posts (1) so that the head panel (9)is laid vertically on the front upper part of the posts (1), with the head panel fingers (81) coming into the respective indentations (83) of the post and being hooked and locked therein by engaging the hooks to the front while the head panel (9) is pressed against the posts (1).

13. Assembly method for a paint stirring machine claimed in claim 4, characterized in that other accessories can also be mounted, such as the control switch (85) for machine operation, which is also snap-locked on the drive post (1) with an automatic contact connection to the electrical power supply system of the machine.

14. Assembly method for a paint stirring machine as claimed in claim 4, characterized in that the gear motor set (5) can be replaced by a number of small electric motors (87) arranged into the post to replace the shelf bearing pulleys and driving the worm gears (11) of the shelves directly via external bearings (19), wherein the motors can also turn at varying speeds and at a different speed from each other.

* * * * *